United States Patent [19]

Williams et al.

[11] Patent Number: 4,686,549

[45] Date of Patent: Aug. 11, 1987

[54] RECEPTOR SHEET FOR THERMAL MASS TRANSFER PRINTING

[75] Inventors: Donald J. Williams; Marvin R. Kammin, both of St. Paul, Minn.

[73] Assignee: Minnesota Mining and Manufacturing Company, St. Paul, Minn.

[21] Appl. No.: 809,494

[22] Filed: Dec. 16, 1985

[51] Int. Cl.[4] ..... B41M 5/26

[52] U.S. Cl. ..... 503/227; 503/1.1; 503/135.1; 428/207; 428/212; 428/409; 428/480; 428/484; 428/500; 428/523; 428/913; 428/914

[58] Field of Search ..... 428/195, 488.1, 488.4, 428/913, 914, 207, 212, 409, 480, 484, 500, 523; 346/227

[56] References Cited

U.S. PATENT DOCUMENTS 3,898,086 8/1975 Franer et al. ..... 96/28

FOREIGN PATENT DOCUMENTS 2069160A 8/1981 United Kingdom ..... 428/914

*Primary Examiner*—Bruce H. Hess

*Attorney, Agent, or Firm*—Donald M. Sell; James A. Smith; David L. Weinstein

[57] ABSTRACT

Receptor sheet suitable for thermal mass transfer printing. The receptor sheet comprises a polymeric backing bearing on at least one major surface thereof a wax-compatible, image receptive layer having a softening temperature in the range of about 30° C. to about 90° C., the surface of said image receptive layer having a higher critical surface tension than the donor material of the donor sheet from which pigmented wax is transferred to the receptor sheet to form images thereon. A preferred receptor sheet comprises a backing made of polyethylene terephthalate and an image receptive layer formed from a blend of a wax and a copolymer of ethylene and vinyl acetate.

15 Claims, 2 Drawing Figures

RECEPTOR SHEET FOR THERMAL MASS TRANSFER PRINTING

BACKGROUND OF THE INVENTION

This invention relates to thermal mass transfer printing, and, in particular, to a novel receptor sheet for such printing.

In thermal mass transfer printing, an image is formed on a receptor sheet by selectively transferring image-forming material thereto from a donor sheet. Material to be transferred from the donor sheet is selected by a thermal printhead, which consists of small, electrically heated elements which are operated by signals from a computer in order to transfer image-forming material from the donor sheet to areas of the receptor sheet in an image-wise manner.

There are essentially two broad classes of donor sheet-receptor sheet systems—(1) chemical reaction systems and (2) mass transfer systems.

In chemical reaction systems, the image is formed upon the receptor sheet as a result of the imagewise transfer of some chemical reactant from the donor sheet. An example is the transfer of a mobile molecule, such as a phenol, to the receptor sheet, which bears a leuco compound thereon. The phenol is transferred by being volatilized by the heat from the thermal printhead, and, upon reaching the receptor sheet, reacts with the leuco compound to convert it from the colorless to the colored form. Alternatively, the phenol can be on the receptor sheet and the leuco compound can be on the donor sheet.

In mass transfer systems, no color-forming chemical reaction takes place. Instead, the image is formed simply by the transfer of the coloring material itself.

In U.S. Pat. No. 3,898,086, a wax composition is transferred imagewise to a receptor film by means of heat which melts the wax and allows it to readhere, upon cooling, to the receptor film. The final step in this process is the separation of the donor sheet and receptor film by pulling them apart. The donor sheet, which bears a negative image, is then used as a visual transparency. The receptor film used in this process is not of sufficient transparency to be useful for projection. In another wax transfer process described in DE No. 3,143,320, pressure, rather than heat, is used to effect the transfer. Such pressure can come from a pen, pencil, or typewriter, or other pressure-applying device. This system is not adaptable to thermal printing processes with the type of apparatus currently in use.

A typical donor sheet that is useful with thermal printers currently on the market comprises a paper or film backing having a layer of a pigmented wax coated thereon. Such a sheet is described in Seto, et al., U.K. Patent Application No. GB 2,069,160 A. The layer of transfer material comprises 1 to 20% by weight coloring agent, 20 to 80% by weight binder, and 3 to 25% by weight softening agent. A solid wax having a penetration of 10 to 30 is preferred as the binder. The softening agent is an easily meltable material such as polyvinyl acetate, polystyrene, etc. In order for image transfer to occur in such a system, the wax must soften sufficiently so that it can be released from its backing, and transfer to the receptor sheet in imagewise manner, but it should not become so soft as to run or move about on the receptor sheet. At the instant of transfer, the pigmented wax is held between the competing forces of the backing of the donor sheet and the image receptive surface of the receptor sheet. If the receptor sheet is paper, the transfer occurs by a combination of adhesion, capillary action, and mechanical intermingling of wax and paper fibers. Because the porosity of paper makes the adhesion area of the paper receptor sheet much greater than the surface area occupied by the image on the donor sheet, release from the backing of the donor sheet and transfer to and adhesion on the paper receptor sheet is favored.

If the receptor sheet is polymeric film, transfer depends entirely upon the adhesion of the softened pigmented wax to the relatively smooth film surface. In the absence of the mechanical coupling of pigmented wax to the receptor sheet, such as is provided by the pores of a paper surface, the adhesive properties of the polymeric film surface become critical. Adequate imaging will occur only if the adhesion between the pigmented wax and the film surface of the receptor sheet overcomes the adhesion of the wax to the backing of the donor sheet. It has been found that pigmented wax from a donor sheet does not reliably adhere to bare, untreated polyethylene terephthalate film because lack of compliance of the surfaces of the donor sheet and receptor sheet makes contact between pigmented wax of the donor sheet and image receptive surface of the receptor sheet difficult. Corona treatment of the polyethylene terephthalate film just prior to imaging improves wax transfer, but this is not a practical alternative for use in an office setting. A further difficulty in the use of bare, untreated polyethylene terephthalate film for thermal transfer imaging is the heat capacity of this material, which limits the range of useable calipers to a maximum of approximately 2 mils (50.8 micrometers). Films having calipers greater than this cannot be heated sufficiently to achieve the temperature needed for imaging.

Ideally, a receptor sheet made of polymeric film should have the characteristics of high clarity, reliable feedability in conventional thermal mass transfer printers, good handleability, and good adhesion of image-forming material. Haze should be below 15% as measured on the Gardner hazemeter, a level of 10% or less being preferred. The receptor sheet should preferably add no detectable color to the printed image. The receptor sheet should preferably feed reliably through the printer without sticking or jamming and without the need for any modification to printers originally designed to make paper copies. The receptor sheet should preferably be capable of being easily handled, without stickiness or susceptibility to excessive fingerprinting, which would add visible defects to the sheet noticeable upon projection. This is particularly important with respect to transparencies made from the receptor sheet. Transfer of pigmented wax from the donor sheet to the receptor sheet should preferably be complete in the areas to be imaged, and there should not be excessive wax transfer in areas to be free of the printed image. Sensitivity to small dots and thin lines is a desired feature and solid dark areas should appear solid when projected. The receptor sheet should also provide acceptable images for any caliper of film in the range of 1.5 to 7.0 mils.

SUMMARY OF THE INVENTION

This invention involves a receptor sheet made of polymeric film suitable for use with conventional thermal mass transfer printing apparatus. The receptor sheet of this invention comprises a backing bearing on at least one major surface thereof a wax-compatible, image receptive layer having a softening temperature in the range of about 30° C. to about 90° C. in order to soften and receive donor material, e.g. pigmented wax, from a donor sheet during the thermal imaging operation, the surface of said layer having a higher critical surface tension than the donor material, so that softened donor material from the donor sheet will wet the image receptive layer. The image receptive layer of the receptor sheet preferably has a critical surface tension of at least 31 dynes per cm, since this is approximately the critical surface tension of most waxes expected to be borne on the surface of the donor sheet. In another aspect, this invention involves a method of imaging the aforementioned receptor sheet.

The backing can be made of any flexible, polymeric material to which an image recepteive layer can be adhered. A preferred backing material is polyethylene terephthalate. A preferred image receptive layer can be formed from an ethylene vinyl acetate copolymer blended with a paraffin wax, a microcrystalline wax, or mixture of both. Antioxidants, tackifiers, and other additives may also be contained in the image receptive layer.

The receptor sheet of this invention is suitable for use in commercially available thermal mass transfer printers.

BRIEF DESCRIPTION OF THE DRAWINGS

The invention is described in detail hereinafter with reference to the accompanying drawings wherein like reference characters refer to the same parts throughout the views and in which.

DETAILED DESCRIPTION

Figure 1:
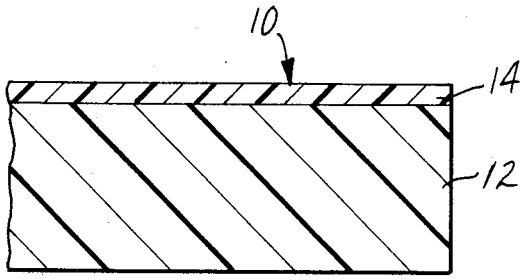
FIG. 1 is a cross-sectional view of the receptor sheet of this invention.

Referring to FIG. 1, there is shown a receptor sheet 10 comprising a backing 12 and an image receptive layer 14.

The backing 12 should be sufficiently flexible in order to be able to travel through conventional thermal mass transfer printers. Whenever the receptor sheet 10 is to be used for preparing transparencies for overhead projection, the backing 12 must be transparent to visible light. Representative examples of materials that are suitable for the backing 12 include polyesters, polysulfones, polycarbonates, polyolefins, such as polypropylene, polystyrenes, cellulose esters, such as cellulose acetate and cellulose acetate butyrate. A preferred backing material is polyethylene terephthalate.

The image receptive layer 14 must be compatible with wax, since most commercially available donor sheets are wax-based. Because different manufacturers generally use different wax formulations in their donor sheets, the image receptive layer 14 should preferably have an affinity for several different waxes, such as beeswax, carnauba wax, paraffin wax, microcrystalline wax, and other synthetic hydrocarbon waxes.

A simple, useful test for determining whether a material for the image receptive layer is compatible with wax consists of dissolving 20 grams of wax in 80 grams of hot toluene. In a second container, 20 grams of the material being tested is dissolved in 180 grams of toluene. The two solutions are then mixed and coated onto polyester film at 0.63 mils wet thickness with a wire-wound coating rod, then dried with hot forced air at about 82° C. The haze of the coating resulting therefrom must be less than 15% for the material being tested to be considered compatible with wax. Haze can be measured using a Gardner Model HG 1200 pivoting sphere hazemeter or equivalent instrument according to ASTM D1003 (1977). If toluene is not a suitable solvent for the test, other solvents may be used as long as the dried coating weight is comparable to that described above.

The critical surface tension of the surface of the image receptive layer 14 must be sufficiently high to assure that the image receptive layer 14 of the receptor sheet 10 is wet by the wax of the donor sheet when the wax is in the molten state. Wetting will occur only if the surface tension of the donor material is below that of the surface of the image receptive layer 14. Since most waxes, particularly in the molten state, have values of surface tension of 31 dynes per centimeter or less, this condition can usually be met by choosing for the image receptive layer 14 polymers having a critical surface tension of at least 31 dynes per centimeter.

Critical surface tension is a measure of the "wettability" of a solid surface, and surfaces having higher wettability exhibit higher values of critical surface tension. Calculation of the critical surface tension of a material consists of recording contact angles of drops of various liquids on the surface of a layer of material being evaluated, plotting a curve of contact angle against surface tension of the liquid, and extrapolating to a contact angle of zero. The critical surface tension is the surface tension which a liquid would have to have in order to just form a droplet with zero contact angle with the surface under consideration. Surface tension of liquids can be measured by means of a du Nouy tensiometer, using adaptations of methods given in ASTM D1331 (1980). Materials suitable for image receptive layers should preferably have a critical surface tension above 31 dynes per centimeter, more preferably above 35 dynes per centimeter.

Because the transfer of donor material to the receptor sheet 10 is essentially an adhesion process, it is important that there be intimate contact between donor sheet and receptor sheet 10 at the instant of imaging, and that during the period of contact, the image receptive layer 14 be in a softened condition. The image receptive layer 14 should soften at a temperature below the imaging temperature, more specifically, between about 30° C. and about 90° C., and preferably between about 60° C. and about 80° C. The imaging temperature is normally 90° C. or higher. Softening temperature, as used herein, means Vicat softening temperature determined in accordance with ASTM D1525 (1982) for polymers with no sharp melting point, or, for polymers which do exhibit a sharp melting point, the melting point itself. A softening temperature below about 30° C. is not desirable, since the layer 14 is then likely to become tacky and soft at normal room temperatures. This would lead to fingerprinting, blocking of stacked film, and other undesirable handling characteristics. In some cases, the softening temperature of image receptive layers formed from certain polymers can be raised by blending wax with the polymer. However, this technique may introduce haze, unless the polymer and wax have a relatively high degree of compatibility. A softening temperature above about 90° C. is not desirable, since the image receptive layer 14 is unlikely to soften sufficiently to receive wax from the donor sheet at the imaging temperature.

The proper selection of critical surface tension and softening temperature, as described above, are necessary conditions for a useful receptor sheet 10 for thermal mass transfer printing. In addition, in order for the receptor sheet 10 to be useful in a commercial setting, the receptor sheet is preferably non-tacky and handleable under the conditions to which overhead transparencies are normally subjected; it is preferably capable of being fed reliably in conventional thermal mass transfer printers; and it is preferably of sufficient durability so that it will remain useable after such handling and feeding. If the receptor sheet is to be used for preparing transparencies, such as for overhead projection, the image receptive layer should be transparent to visible light.

A useful measure of how well a particular receptor sheet 10 and image receptive layer 14 thereof meets the commercial requirement of reliable feeding in a conventional thermal mass transfer printer is the coefficient of static friction measured against aluminum according to ASTM D1894 (1978). Aluminum was chosen as the reference surface because tests on a variety of receptor sheet samples have shown aluminum to be a reliable indicator of those properties which have been found important in the general handling and feeding of transparency films. For example, coefficients of static friction greater than 1.0 indicate rubbery or tacky surfaces. Coefficients of static friction above 0.6 indicate, for smooth, non-abrasive surfaces, that the surface may be somewhat soft, but still useable for thermal mass transfer printing. An image receptive layer 14 having a coefficient of static friction below 0.5 should handle well and feed reliably in most commercially available thermal mass transfer printers, though the exact coefficient of friction which can be tolerated is dependent upon the mechanical details of a given thermal printer, and upon such features of the backing 12 as beam strength, and hence caliper. For a particular make and model of thermal mass transfer printer, the acceptable range of coefficient of static friction can be determined by feeding sample receptor sheets through that printer.

It has been found that the addition of suitable additives, such as wax, to the composition for preparing the image receptive layer can have a beneficial effect in reducing coefficient of static friction without adversely affecting imageability. However, such additions may produce the detrimental side effect of increasing haze. If, for example, wax is to be used for friction reduction or other property improvements, it is desireable to add only a small amount thereof, so as to keep haze to a minimum. The formulations described herein allow coefficients of static friction as low as about 0.25, without exceeding a haze level of 15%.

In some cases, the surface of the image receptive layer 14 may tend to be tacky, and consequently, the receptor sheet 10 may be difficult to feed into the printer. This tackiness may also result in unwanted pigment transfer in the unimaged background areas. By incorporating certain waxes, at an appropriate level, into the composition from which the image receptive layer is formed, it has been found that, at room temperature, such waxes prevent adjacent sheets from sticking together or single sheets from jamming in the printer. During the printing process, such waxes prevent pigmented wax from the donor sheet from sticking to the image receptive layer 14 in the unimaged background areas. However, at imaging temperatures, which are well above the melting point of the wax, the wax can combine with the softened, pigmented wax of the donor sheet and promote bonding between the pigmented wax and the image receptive layer 14 of the receptor sheet.

Adhesion of the image receptive layer 14 to the backing 12 is vital to receptor sheet performance. Transfer of the pigmented wax from the donor sheet to the image receptive layer 14 is useful only if the anchoring of the image receptive layer 14 to the backing 12 is sufficiently strong to allow the image receptive layer to remain on the backing. In some cases, adhesion of the image receptive layer to the backing can be improved by incorporation of adhesion promoters into the composition from which the image receptive layer is formed. It is also possible, in some cases, that adhesion promoters may also serve a second function of improving the adhesion of the pigmented wax to the image receptive layer.

Materials that have been found to be useful for forming the image receptive layer 14 include chlorinated polyolefins, polycaprolactones, blends of chlorinated polyolefin and polymethyl methacrylate, block copolymers of styrene-ethylene/butylene-styrene, and copolymers of ethylene and vinyl acetate. Preferably, copolymers of ethylene and vinyl acetate should contain from about 10% to about 40% vinyl acetate units, and blends of chlorinated polyolefins and polymethyl methacrylate should contain no more than about 50% by weight polymethyl methacrylate. Waxes that have been found to be useful for incorporation into the composition for forming the image receptive layer 14 include paraffin wax, microcrystalline wax, beeswax, carnauba wax, and synthetic hydrocarbon waxes. The amount of wax used should not exceed 50% by weight of the image receptive layer. Preferably, the amount of wax may comprise up to 20% by weight of the image receptive layer; more preferably, the amount of wax may comprise up to 12% by weight of the image receptive layer.

Various additives or modifying agents such as antioxidants and tackifiers may also be included in the image receptive layer.

The caliper of the receptor sheet 10 can range from about 1.5 mils to about 7 mils. A preferred caliper is about 3 mils about 5 mils. Typical coating weights for the image receptive layer 14 range from about 0.05 to about 2.0 grams per square foot.

An opaque sheet may also be adhered to the side of the backing 12 opposite the side bearing the image receptive layer 14 in order to facilitate feeding of the receptor sheet 10 into the thermal mass transfer printing apparatus.

The receptor sheet 10 can be prepared by introducing the ingredients for making the image receptive layer 14 into suitable solvents, mixing the resulting solutions at ambient temperature, e.g,. 25° C., then coating the resulting mixture onto the backing 12, and drying the resulting coating, preferably in a forced air oven. Suitable coating techniques include knife coating, roll coating, air knife coating, curtain coating, etc. While the technique described above makes use of coating solutions, other methods of blending or coating may be used. Other possible techniques include latex suspensions and hot melt systems.

The resulting receptor sheet 10 is useful for thermal mass transfer imaging processes with conventional thermal mass transfer printing apparatus, e.g., "Fuji Xerox Diablo" Model XJ-284 and "Okimate" Models 10 and 20 and conventional thermal mass transfer donor sheets, e.g., "Diablo" T052 Donor and "Okimate" donor ribbon.

Figure 2:
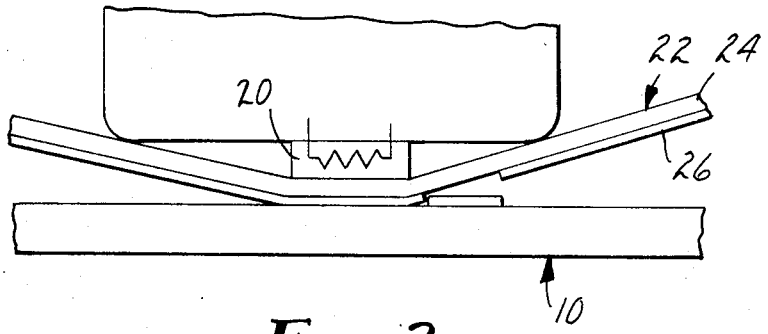
FIG. 2 shows one method by which the recepteor sheet is imaged.

In FIG. 2, the receptor sheet 10 of this invention can be imaged in a thermal mass transfer printer (not shown) wherein the printing is conducted by a thermal head 20 which heats the donor sheet 22 in an imagewise manner. The donor sheet 22 comprises a backing 24 and a layer of donor material 26. A useful donor sheet is described in UK Pat. Application No. GB 2,069,160 A, incorporated herein by reference. The backing 24 is generally a plastic film or paper, e.g. polyethylene film, polystyrene film, polypropylene film, glassine paper, synthetic paper, laminated paper. The donor material 26 is formed from a composition containing 1 to 20% by weight of a coloring agent, 20 to 80% by weight of a binder, and 3 to 25% by weight of a softening agent. The binder is normally a wax, e.g. haze wax, beeswax, ceresine wax, spermaceti. The softening agent is normally an easily heat meltable material, e.g. polyvinyl acetate, polystyrene, styrene-butadiene copolymer. The coloring agent is normally a conventional pigment. The thermal head 20 generates heat by pulse signals from a signalling device (not shown) so as to melt the donor material 26 and allow transfer thereof from the donor sheet 22 to the image receptive layer 14 of the receptor sheet 10. The image receptive layer 14 is softened by heat from the thermal head 20 that is conducted through the donor sheet 22. The thermal mass transfer printer is typically constructed so that pressure-applying means induces intimate contact between the donor sheet 22 and receptor sheet 10 to allow effective transfer of the donor material 26 to the image receptive layer 14.

In order to more clearly point out the advantages of the invention, the following non-limiting examples are provided. In these examples, haze was measured in accordance with ASTM D1003, and critical surace tension was calculated as described previously through the employment of ASTM D1331.

EXAMPLE I

A 20% by weight solution of ethylene vinyl acetate copolymer ("Elvax" 310, 25% by weight vinyl acetate, E. I. DuPont de Nemours) was prepared by dissolving 20 grams of solid copolymer in 80 grams of toluene. A 20% by weight paraffin wax solution was prepared by dissolving 20 grams of paraffin wax ("Histowax" HX0482-5, EM Science, melting point 56° C.) in 80 grams of toluene. A wax/copolymer blend was then formed by mixing the foregoing solutions together. The resulting solution was coated onto a 4 mil polyethylene terephthalate (PET) backing using an #7 RDS wirewound coating rod at a coating weight of about about 0.05 to about 0.07 gram per square foot. Drying was conducted in a forced air oven at 82° C. for two minutes. The dried coating consisted of 50% by weight wax and 50% by weight ethylene vinyl acetate copolymer. Haze was less than 15%. The coefficient of static friction of the image receptive layer against aluminum was 0.2. The critical surface tension of ethylene vinyl acetate is approximately 32 dynes per centimeter. The softening temperature of "Elvax" 310 copolymer is 88° C., as measured by the ring and ball method (ASTM E2-8-67 (1982)), which corresponds to a Vicat softening temperature of approximately 32° C. The sheet fed reliably in a Fuji-Xerox Diablo printer and provided a satisfactory printed image.

EXAMPLE II

Example I was repeated, the only exception being that the coating solution was applied at a coating weight of 2.0 grams per square foot, instead of 0.05 to 0.07 grams per square foot. The characteristics of the resulting film were similar to those of the film in Example I, and images formed thereon were also of excellent quality. This illustrates that the performance of the film is relatively insensitive to the coating weight of the image receptive layer over a relatively wide range.

EXAMPLE A (COMPARATIVE)

A solution of 5 grams styrene-butadiene-styrene copolymer ("Kraton" 1101, Shell Chemical Company) and 5 grams paraffin wax ("Histowax" HX0482-5) in 90 grams of toluene was coated onto a 4 mil PET backing and dried at 82° C. in a forced air oven for three minutes. The resulting image receptive layer had a coefficient of static friction against aluminum of 0.30. Haze was less than 10%. The softening temperature of the elastomeric moiety of "Kraton" 1101 copolymer is approximately 20° C., which is outside the prescribed range of 30°-90° C. Although the film fed reliably through the printer, the resulting copy showed incomplete fill of solid areas and failure to print solid lines. This example illustrates the criticality of the range of softening temperature.

EXAMPLE B (COMPARATIVE)

A 10% by weight solution of polymethyl methacrylate ("Elvacite" 2041, E. I. DuPont de Nemours) in a solvent containing 50% toluene and 50% methyl ethyl ketone was coated onto a 4 mil PET backing with a #7 wirewound rod and dried at 82° C. for two minutes in a forced air oven. The softening temperature of polymethyl methacrylate is approximately 107° C., which is outside the prescribed range of 30°-90° C. The critical surface tension of polymethyl methacrylate is 39 dynes per centimeter. Although the film fed reliably through the printer, only about 30% of the image was transferred to the receptor sheet. The characters were not completely filled in and had blank spaces where small dots should have appeared.

EXAMPLE III

A 25% by weight solution of chlorinated polyolefin (CP153-2, Eastman Chemical Products, Kingsport, Tenn.) in xylene was blended with a 20% by weight solution of paraffin wax ("Histowax" HX0482-5) in toluene to form a solution which, when dried, would form a solid coating consisting of 12.5% by weight wax and 87.5% by weight chlorinated polyolefin. This solution was coated onto a 4 mil PET backing at coating weights of 0.35, 0.71, 1.1, and 2.1 grams per square foot and dried in a forced air oven at 82° C. for three minutes. Chlorinated polyolefin has a critical surface tension of approximately 38 dynes per centimeter, and a Vicat softening temperature of 57° C. The coefficients of static friction of the coatings against aluminum were in the range of 0.33 to 0.40.

Feeding into the printer was acceptable regardless of coating weight. All of the image receptive layers provided acceptable printed images, but the samples having lower coating weights showed slight pinholing in the larger solid fill areas. This pinholing was progressively reduced by going to higher coating weights, until at a coating weight of 2.1 grams per square foot, there were almost no pinholes. This illustrates that even though acceptable copies can be produced over a wide range of coating weights, there can still exist a narrower range of optimum coating weights within the wide range.

EXAMPLE IV

A coating composition consisting of equal parts ethylene vinyl acetate copolymer ("Elvax" 410, 18% vinyl acetate, E. I. DuPont de Nemours) and paraffin wax ("Histowax" HX0482-5) dissolved in toluene was applied to a 4 mil PET backing and dried at 82° C. for three minutes. When the thus-formed receptor sheet was run in the Fuji-Xerox Diablo printer, image quality was very poor. Examination of the copies showed that the entire image receptive layer was detaching from the backing and sticking to the donor sheet.

In a second run, a coating of the type described above was subjected to a 15 watt ultraviolet light for 24 hours. This treatment, which was similar to the treatment described in U.S. Pat. Nos. 3,188,265 and 3,188,266, resulted in greatly improved adhesion between the backing and image receptive layer, and the receptor sheet derived from this treatment yielded an acceptable printed image. This illustrates the importance of providing good adhesion of the image receptive layer to the backing, and that the range of useful image receptive layers can be extended by the use of special treatments such as ultraviolet radiation.

EXAMPLE V

A 20% by weight solution of polycaprolactone (Union Carbide PCL700) in toluene was coated onto a 4 mil PET backing with a #7 RDS wire wound rod. Polycaprolactone has a melting point of 60° C. and a critical surface tension of approximately 40 dynes per centimeter. The resulting coating was dried at 82° C. for five minutes in a forced air oven. The image receptive layer had a coefficient of static friction against aluminum of 0.30. The receptor sheet fed reliably through the Fuji Xerox Diablo printer and the resulting image exhibited good optical density with no backgrounding.

EXAMPLE VI

A 25% by weight solution of equal parts chlorinated polyolefin (PC153-2, Eastman Chemical Corp.) and polymethyl methacrylate ("Elvacite" 2041) in toluene was coated onto a 4 mil PET backing with a #7 RDS wire wound rod. The resulting coating was dried at 82° C. for five minutes in a forced air oven. Haze was less than 10%, the coefficient of static friction was about 0.3, and feeding and imaging were acceptable. This illustrates that a polymer such as polymethyl methacrylate which was unsatisfactory in Comparative Example C, when used alone, can be made to work by blending it with another polymer, such as chlorinated polyolefin, which was shown to work well in Example III.

EXAMPLE VII

A solution prepared by dissolving 17.5 grams of a block copolymer made up of styrene/ethylenebutylene/styrene chains ("Kraton" G-1652, Shell Chemical Company) and 2.5 grams of paraffin wax ("Histowax" HX0482-5) in 80 grams of toluene was coated onto a 4 mil PET backing using a #7 RDS wirewound coating rod. The critical surface tension of "Kraton" G-1652 copolymer is estimated to be just over 31 dynes per centimeter, and the Vicat softening temperature this block copolymer is within the prescribed range of 30°-90° C. The coefficient of static friction of the coating was 0.26, feeding into the printer was reliable, and image quality was acceptable.

Example VIII

A 4 mil PET backing was coated as in Example I with a 20% by weight solution of ethylene vinyl acetate copolymer ("Elvax" 310) in toluene, but without any added wax. The image receptive layer had a coefficient of static friction against aluminum of 1.50 and a softening temperature of about 88° C. Haze was less than 4%. When fed through the Fuji-Xerox Diablo printer used in Example I, the film jammed and the machine had to be opened to remove the crumpled film. However, images of excellent quality can be formed on the image receptive layer.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A receptor sheet suitable for receiving donor material in an imagewise manner from a donor sheet by means of thermal mass transfer printing comprising a transparent backing having on at least one major surface thereof a transparent image receptive layer comprising a wax-compatible material having a softening temperature of about 30° C. to about 90° C., and a critical surface tension exceeding that of the donor material of the donor sheet, said image receptive layer sufficiently anchored to said backing to allow the image receptive layer to remain on the backing upon transfer of said donor material from said donor sheet to said image receptive layer, said receptor sheet having a haze value of less than 15%.

2. The sheet of claim 1 wherein the backing is a sheet of flexible, polymeric material.

3. The sheet of claim 2 wherein the backing is transparent to visible light.

4. The sheet of claim 2 wherein the backing is polyethylene terephthalate.

5. The sheet of claim 1 wherein the image receptive layer is transparent to visible light.

6. The sheet of claim 1 wherein the image receptive layer comprises a polymeric material.

7. The sheet of claim 6 wherein the image receptive layer further comprises a wax.

8. The sheet of claim 6 wherein the polymeric material is selected from the group consisting of polycaprolactones, chlorinated polyolefins, blends of chlorinated polyolefin and polymethyl methacrylate, block copolymers of styrene-ethylene/butylene-styrene, and copolymers of ethylene and vinyl acetate.

9. The sheet of claim 1 wherein the critical surface tension of the image receptive layer is equal to or greater than 31 dynes per centimeter.

10. The sheet of claim 1 wherein the coefficient of static friction of the image receptive layer as measured against aluminum according to ASTM D1894 (1978) is less than about 0.50.

11. The sheet of claim 1 wherein the image receptive layer and the backing are transparent to visible light.

12. A method of forming an image on a receptor sheet comprising the steps of:

a. providing a receptor sheet comprising a transparent backing having on at least one major surface thereof a transparent image receptive layer comprising a wax-compatible material having a softening temperature of about 30° C. to about 90° C., and a critical surface tenison exceeding that of donor material of a donor sheet, said image receptive layer sufficiently anchored to said backing to allow the image receptive layer to remain on the backing upon transfer of said donor material from said donor sheet to said image receptive layer, said receptor sheet having a haze value of less than 15%, and b. transferring image-forming material borne on a donor sheet in an imagewise manner to the image receptive layer of said receptor sheet.

13. The method of claim 12 wherein said donor sheet comprises a backing bearing on at least one major surface thereof a layer of transferable image-forming material.

14. The method of claim 12 wherein said image-forming material comprises wax and a coloring agent.

15. The method of claim 12 wherein said transfer of image-forming material is effected by heat and pressure.

* * * * *